US006024250A

United States Patent [19]

Hickey

[11] Patent Number: 6,024,250

[45] Date of Patent: Feb. 15, 2000

[54] TIP SEALING SYSTEM FOR NON-CONTACT GLUE APPLICATOR

[76] Inventor: Patrick J. Hickey, Heatherwood #3, East Wellow Romsey, Hampshire, United Kingdom, 50516 AW

[21] Appl. No.: 09/013,233

[22] Filed: Jan. 26, 1998

[51] Int. Cl.[7] ..... B67D 1/16

[52] U.S. Cl. ..... 222/63; 222/108; 222/389; 222/504; 222/517

[58] Field of Search ..... 222/63, 108, 389, 222/504, 517

[56] References Cited

U.S. PATENT DOCUMENTS 3,782,599 1/1974 Luginbuhl ..... 222/108

4,324,348 4/1982 Johnson et al. ..... 222/517

5,240,502 8/1993 Castaldo et al. ..... 222/108

*Primary Examiner*—Joseph A. Kaufman

*Attorney, Agent, or Firm*—Zachary T. Wobensmith, III

[57] ABSTRACT

A Tip Sealing System for Non-contact Glue Applicators which dispense high viscosity adhesives in a straight line onto card stock or heavy paper, which applicator includes an outer body mounted in an arm which is attached to a machine which applicator is connected to source of glue under pressure, which body has an extruder nozzle with a nozzle tip attached thereto, a pneumatic cylinder in the arm connected to a source of air or vacuum, a rod in the cylinder which engages an actuator plate of a tip sealing assembly, the tip sealing assembly is mounted on a shaft and has a tip seal arm with a pad thereon resilently urged into contact with the nozzle tip.

5 Claims, 2 Drawing Sheets

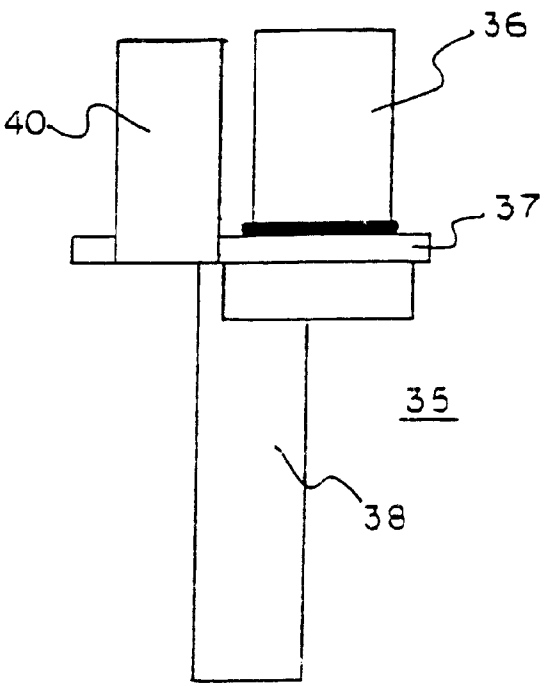
FIG. 3
FIG. 2
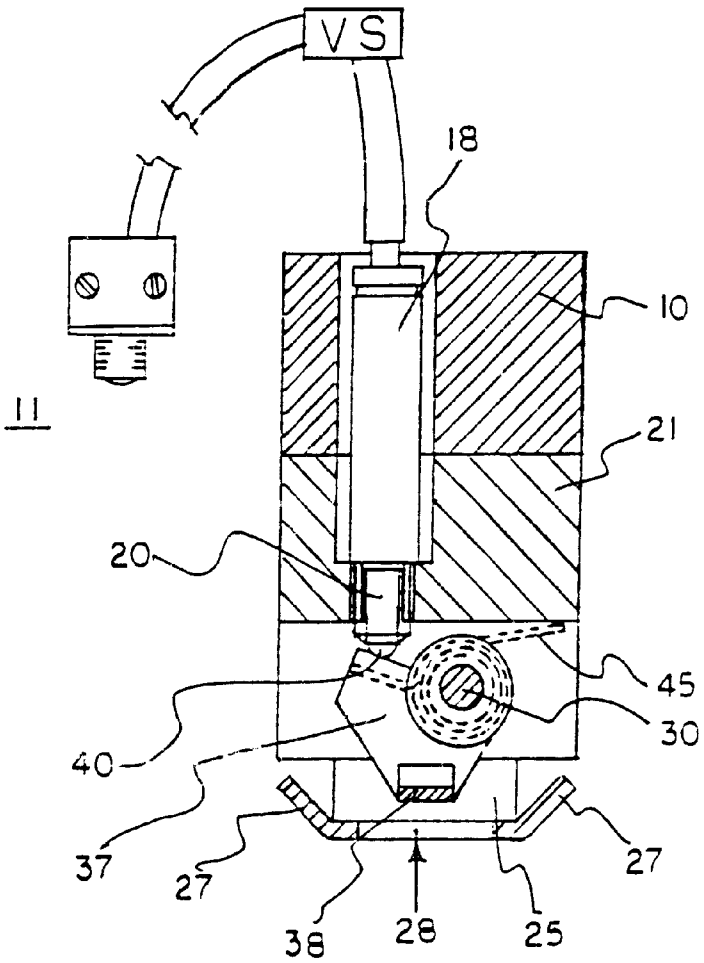

TIP SEALING SYSTEM FOR NON-CONTACT GLUE APPLICATOR

BACKGROUND OF THE INVENTION

1. Field of the Invention

This invention relates to a Tip Sealing System for a Non-contact Glue Applicator of the type which extrudes high viscosity adhesives through an extruder nozzle, which system uses an automatic rotatable wiper arm to seal off the nozzle tip between glue applying operations.

2. Description of the Prior Art

High viscosity adhesives, that is adhesives which have a high solids content and are stiff, are difficult to extrude from a nozzle with any degree of reliability, and are susceptible to drying at the nozzle tip causing blockage, or dispensing difficulties.

Such nozzles after dispensing glue often have a residual amount that remains at the tip of the nozzle, which can dry or drip onto the equipment on which the nozzle is mounted.

The prior art systems attempted to prevent these problems by controlling the amount of glue dispensed, or by internal nozzle mechanisms but they did not always prevent residual glue drops on the outside of the nozzle tip.

It is desireable to provide a glue applicator which dispenses glue when activated, in a predetermined amount without the neccesity of manually cleaning off the nozzle between dispensing operations, and which performs consistently.

The Tip Sealing System of the invention, for Non-contact Glue Applicators, seals off the tip of a glue dispensing nozzle between gluing operations i.e. when the machine is off, provides repeatable results, does not suffer from the disadvantages of the prior art, and provides positive advantages.

SUMMARY OF THE INVENTION

This invention relates to a Tip Sealing System for a Non-contact Glue Applicator which is carried in a mounting arm, which also carries a glue dispensing nozzle, which arm is clamped to a machine where glue is to be dispensed onto a line of paper stock, which uses a vacuum operated pneumatic cylinder to cause a wiper arm which normally seals off a nozzle tip to rotate away from the tip of the nozzle for glue dispensing, with spring return of the arm to seal off the nozzle tip when the machine is off.

The principal object of the invention is to provide a Tip Sealing System for the nozzle tip of a Non-contact glue applicator which extrudes high viscosity adhesives.

A further object of the invention is to provide a Tip Sealing System for a Non-contact Glue Applicator that is consistent in operation.

A further object of the invention is to provide a Tip Sealing System for a Non-contact Glue Applicator that is activated by detecting the presence of paper stock.

A further object of the invention is to provide a Tip Sealing System for a Non-contact Glue Applicator that is sturdy and reliable in operation.

A further object of the invention is to provide a Tip Sealing System for a Non-contact Glue Applicator that is simple and inexpensive to construct.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which:

FIG. 2 is a horizontal sectional view, taken approximately on the line 2—2 of FIG. 1, and FIG. 3 is a side elevational view of the tip sealing portion of the invention.

Figure 1:
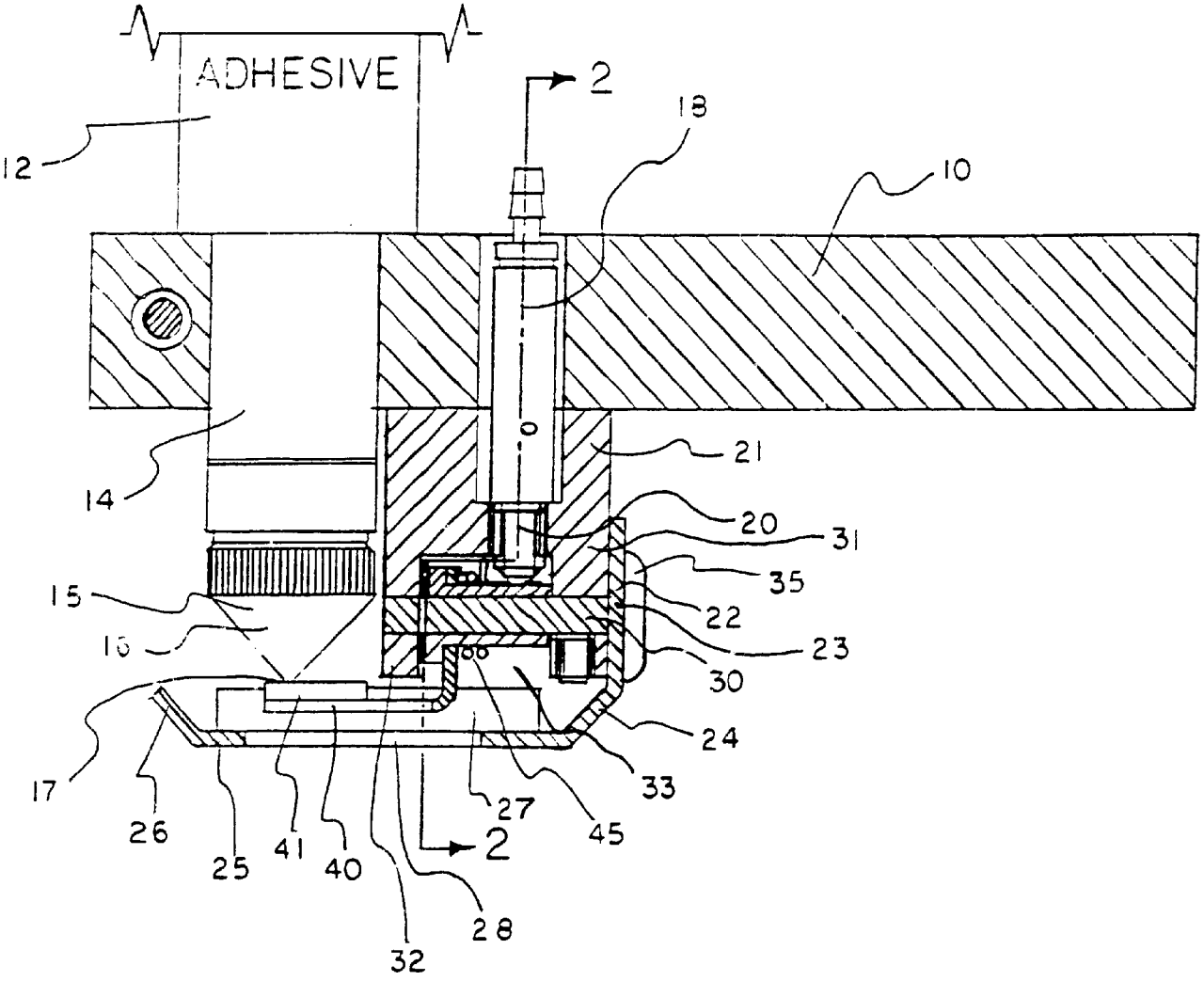
FIG. 1 is a vertical sectional view of a non-contact glue applicator which incorporates the Tip Sealing System.

It should, of course, be understood that the description and drawings herein are merely illustrative and that various modifications and changes can be in the structures disclosed without departing from the spirit of the invention.

Like numerals refer to like parts throughout the several views.

DESCRIPTION OF THE PREFERRED EMBODIMENT

When referring to the preferred embodiment, certain terminology will be utilized for the sake of clarity. Use of such terminology is intended to encompass not only the described embodiment, but also technical equivalents which operate and function in substantially the same way to bring about the same result.

Referring now more particularly to FIGS. 1, 2 and 3 of the drawings, one embodiment of the Tip Sealing System for a Non-contact Glue Applicator is therein illustrated, mounted in an arm 10 which is attached to a bar (not shown) on a machine (not shown), such as a paper folding machine where a line of high viscosity glue is to be deposited onto card stock passing therebelow (not shown).

The arm 10 carries a glue dispensing applicator 12 for dispensing high viscosity adhesive, and which can be as described in my co-pending application Ser. No. 08/884,918, filed Jun. 30, 1997, entitled High Viscosity Low Pressure Non-Contact Glue Applicator now U.S. Pat. No. 5,788,128. The applicator 12 is connected to a source of adhesive (not shown), and includes a body 14 mounted in the arm 10, with an extruder nozzle 15 detachably engaged with body 14, which nozzle 15 is preferably of a suitable plastic such as Delrin.

The nozzle 15 has a cone shaped downwardly sloping surface 16, which terminates at a nozzle tip 17, from which adhesive is dispensed.

The arm 10 also carries the Tip Sealing System to be described, which includes a pneumatic cylinder 18 which may be connected to a source of air under pressure, or preferrably to an intermittent vacuum source which is actuated by an electric eye assembly 11 which detects the presence of paper stock (not shown) and actuates a vacuum source VS to operate cylinder 18. The cylinder 18 has an actuator rod 20 therein for tip sealing operation to be described.

The arm 10 also carries a mounting block 21, which has a paper guide 22 mounted thereto by screws (not shown). The paper guide 22 is of stamped metal, with a plate 23 attached to block 21, and has an angular plate 24 extending from plate 23 to a bottom or contact plate 25, which has an end plate 26 and side plates 27 extending therefrom at an upward angle. The bottom plate 26 has a rectangular opening 28 therein, through which adhesive (not shown) passes onto card stock (not shown) therebelow.

A shaft 30 entends perpendicularly from the plate 23 through an extension 31 of block 21 and is engaged in another extension 32 of block 21.

The block 21 has a cavity 33 between extensions 31 and 32, with a tip sealing assembly 35 therein, mounted to shaft 30.

The tip sealing assembly 35 as illustrated includes a cylindrical portion 36 mounted to and rotatable about the shaft 30, with a top plate 37 extending perpendicularly therefrom, with a horizontally extending plate 38, which is engaged by the actuator rod 20, the plate 37 also has a horizontally extending tip seal arm 40 extending therefrom.

The tip seal arm 40 is provided with a pad 41 of well known material, such as Viton, to engage and seal off the nozzle tip 17.

The pad 41 is normally engaged with the tip 17 when the machine is off, and has a spring 45 carried by the cylindrical portion 36 urging the pad 41 into engagement with tip 17 to seal it off.

The mode of operation will now be described.

The Tip Sealing System is useful with the glue applicator as described in my pending application, and with any non-contact applicator used with any machine which requires a line of adhesive on demand, and is particularly useful with paper folding machines where one or more lines of high viscosity adhesive are deposited on paper stock.

The Tip Sealing System is installed on the equipment (not shown) in a vertical position, the machine is turned on and paper stock (not shown) to which a line of adhesive is to be applied is brought under the paper guide 22.

A suitable high viscosity adhesive (not shown) which can be in the range of 1000 to 3,000 centipoises is introduced into applicator 12 to extruder nozzle 15.

The paper stock (not shown) is detected by an electric eye 11 which causes vacuum to be applied to the cylinder 18 whereby actuator rod 21 moves out against plate 38 and rotates assembly 25 about shaft 30 against the force of the spring 45.

Pad 41 is thereby urged out of its sealing engagement with nozzle tip 17, and adhesive is dispensed therefrom which passes down through opening 28 and is deposited on the paper stock (not shown) below bottom plate 26.

When the gluing operations are finished the machine is turned off and after a delay of three seconds the vacuum is cut off from cylinder 18 causing actuator rod 21 to return into cylinder 18, as spring 45 urges assembly 25 to rotate, and tip arm pad 41 to engage and seal off nozzle tip 17.

The operation can be repeated as required, without the adhesive drying between dispensing operations, or being deposited on the machine or paper stock at non-desired locations.

It will thus be seen that an Tip Sealing System for a Non-contact Glue Applicator has been provided with which the objects of the invention are achieved.

I claim:

1. In combination with a Non-Contact Glue Applicator mounted in an arm which is attached to a machine, which applicator dispenses high viscosity adhesives onto card stock, which applicator includes a hollow outer body, a source of adhesive under pressure connected to said body, an extruder nozzle detachably mounted to said body for dispensing glue from a nozzle tip, a Tip Sealing System for selectively sealing off said nozzle tip which comprises a pneumatic cylinder carried in said arm, an acutuator rod carried by and actuated by said cylinder, a mounting block carried by said arm, a paper guide carried by said mounting block, a shaft extending from said paper guide, a tip sealing assembly mounted to and rotatable about said shaft, said tip sealing assembly having a top plate, an actuator plate extending from said top plate and engaged by said actuator rod for rotation, a tip seal arm extending from said top plate, a pad carried by said tip seal arm to seal off said nozzle tip, spring means carried by said tip sealing assembly to normal urge said pad into engagement with said nozzle tip and card stock detecting means for actuation of said pneumatic cylinder.

2. A Tip Sealing System for a Non-contact glue applicator as defined in claim 1 in which, said applicator body and said extruder nozzle are constructed of Delrin plastic, and said pad is of Viton plastic.

3. A Tip Sealing System for a Non-contact glue applicator as defined in claim 1 in which, said pneumatic cylinder is connected to a source of air under pressure.

4. A Tip Sealing System for a Non-contact glue applicator as defined in claim 1 in which, said pneumatic cylinder is connected to a source of vacuum.

5. A Tip Sealing System for a Non-contact glue applicator as defined in claim 1 in which, said card stock detecting means is an electric eye.

* * * * *